US008123183B2

(12) United States Patent
Ramsauer

(10) Patent No.: US 8,123,183 B2
(45) Date of Patent: Feb. 28, 2012

(54) FIXING DEVICE FOR A PLASTIC MOUNTING OR HOUSING THAT CAN BE FIXED IN A RECTANGULAR OPENING IN A THIN WALL

(76) Inventor: Dieter Ramsauer, Schwelm (DE)

( * ) Notice: Subject to any disclaimer, the term of this patent is extended or adjusted under 35 U.S.C. 154(b) by 1060 days.

(21) Appl. No.: 11/922,801

(22) PCT Filed: Mar. 31, 2006

(86) PCT No.: PCT/EP2006/002930

§ 371 (c)(1),
(2), (4) Date: Dec. 21, 2007

(87) PCT Pub. No.: WO2007/000197

PCT Pub. Date: Jan. 4, 2007

(65) Prior Publication Data

US 2009/0084916 A1 Apr. 2, 2009

(30) Foreign Application Priority Data

Jun. 28, 2005 (DE) ..... 20 2005 010 117 U

(51) Int. Cl.
*A47B 96/00* (2006.01)

(52) U.S. Cl. ..... 248/222.11; 248/222.51; 292/75

(58) Field of Classification Search ..... 248/222.11, 248/222.13, 222.51; 292/DIG. 38, DIG. 53, 292/DIG. 61, 75
See application file for complete search history.

(56) References Cited

U.S. PATENT DOCUMENTS

| | | | | |
|---|---|---|---|---|
| 2,640,672 | A * | 6/1953 | Bedford, Jr. | 248/239 |
| 3,825,289 | A * | 7/1974 | Armstrong | 292/163 |
| 3,841,674 | A | 10/1974 | Bisbing et al. | |
| 4,693,503 | A * | 9/1987 | Bisbing | 292/210 |
| 5,435,159 | A | 7/1995 | Ramsauer | |
| 5,813,793 | A * | 9/1998 | Baucom | 403/325 |
| 5,934,716 | A | 8/1999 | Koveal et al. | |
| 7,093,865 | B2 * | 8/2006 | Furuya | 292/128 |

* cited by examiner

*Primary Examiner* — Terrell McKinnon
*Assistant Examiner* — Bradley Duckworth
(74) *Attorney, Agent, or Firm* — Frommer Lawrence & Haug LLP

(57) ABSTRACT

A fastening device for a fitting or housing of plastic such as a swivel lever control, socket wrench control, or sash closure which can be fixed in at least one preferably rectangular opening in a thin wall such as a sheet metal cabinet door and with tongues which project from the fitting or housing so as to be integral therewith, the free ends of the tongues being supported on the rear rim area or the edge of the opening. A supporting spring which is made of spring metal and which is bent to form a profile that is U-shaped in cross section encloses the free end of the tongue.

18 Claims, 2 Drawing Sheets

FIXING DEVICE FOR A PLASTIC MOUNTING OR HOUSING THAT CAN BE FIXED IN A RECTANGULAR OPENING IN A THIN WALL

CROSS-REFERENCE TO RELATED APPLICATIONS

This is a national phase application of International Application No. PCT/EP2006/002930, filed Mar. 31, 2006 which claims priority German Application No. 20 2005 010 117.6, filed Jun. 28, 2005, the complete disclosures of which are hereby incorporated by reference.

BACKGROUND OF THE INVENTION a) Field of the Invention

The invention is directed to a fitting or housing of plastic such as a swivel lever control, socket wrench control, sash closure with a fastening device for fixing the fitting or housing in at least one preferably rectangular opening in a thin wall such as a sheet metal cabinet door and with tongues which project from the fitting or housing so as to be integral therewith, the free ends of the tongues being supported on the rear rim area or the edge of the opening.

b) Description of the Related Art

A fitting or housing of the type mentioned above is already known from U.S. Pat. No. 5,435,159.

The prior art has the disadvantage that the plastic has only limited strength and is only capable of applying a limited springing force. If greater forces are required, recourse must be had to fastening devices in which the tongues are fashioned from metal spring parts. The drawback in using tongues made of metal is that manufacture and mounting are more complicated and that owing to the fact that a third part must be used there is a risk of losing this part.

OBJECT AND SUMMARY OF THE INVENTION

It is the object of the invention to improve the advantages of the two known constructions in such a way that mounting is simplified and sufficient springing force is ensured at the same time.

The above-stated object is met in that a supporting spring which is made of spring metal and which is bent to form a profile that is U-shaped in cross section encloses the free end of the tongue. This reinforces and lends additional support to the tongue which is made of plastic having only limited strength and also only limited springing force.

On the other hand, the arrangement is also very simple and the fitting or housing of plastic which is provided with the fastening device according to the invention can be fastened in a very simple manner by snapping in.

In a particularly advantageous embodiment form, a supporting leg proceeds from one, inner leg of the U-shaped profile and rests against the housing wall from which the tongue projects. Accordingly, particularly high forces can be absorbed by the tongue without the plastic becoming brittle, for example, due to frequent mounting and disassembly, and without a reduction in fastening strength.

According to another embodiment form of the invention, a bend is provided at the end of the other, outer leg, which bend faces toward the tongue and is received in a slot formed in the latter. This results in a particularly secure positive engagement between the metal spring part and the plastic tongue region.

According to another embodiment form, the supporting leg forms a second U-shaped profile at the point where it joins the leg of the first U-shaped profile, and the outer surface of this second U-shaped profile faces along the housing wall, the tongue surface directed to it, and the transitional area between these two surfaces in a supporting manner. This improves the supporting action.

For the same reason, it is advantageous when the width of the supporting spring is adapted to that of the tongue and is selected in such a way that this width can be received in the transverse extension of the rectangular opening without substantial play, and the spring being locked axially in the opening.

In contrast to the plastic tongue, the springing force of the supporting spring can be adapted to requirements, for example, according to another embodiment form, in that the supporting spring has a greater material thickness where the first U-shaped profile joins the supporting leg and accordingly has a greater springing force than the adjoining area. Naturally, the spring in its entirety can also be made from spring metal of different thickness or different composition for adapting to the desired requirements.

When the outwardly directed surface of the tongue has a recess for receiving the spring thickness in such a way that the abutting outer surfaces of the tongue and spring form a continuous, uninterrupted surface in another embodiment form of the invention, no edges formed by the tongue surface can cause an impediment during the mounting process.

The fitting can be a trough which can be mounted for a swivel lever closure control in one or two rectangular wall openings.

Alternatively, the fitting can be the rectangular housing of a sash closure.

According to another embodiment form, the fitting can be the rectangular escutcheon of a folding lever closure.

According to another embodiment form, the fitting can be the rectangular escutcheon of a socket closure.

Alternatively, the fitting can be the rectangular bearing part of a toggle control, a toggle handle or a latch handle.

According to another embodiment form, the fitting is a rod guide which can be mounted in a rectangular opening.

According to another embodiment form, the fitting is a hinge block which can be mounted in a rectangular opening.

However, the fitting can also be a lever closure which can be mounted in a rectangular opening.

Finally, it is possible that the fitting is a handle trough or a hand grip which can be mounted in a rectangular opening.

BRIEF DESCRIPTION OF THE DRAWINGS

The invention will be explained more fully in the following with reference to embodiment examples shown in the drawings.

DESCRIPTION OF THE PREFERRED EMBODIMENTS

Figure 1A:
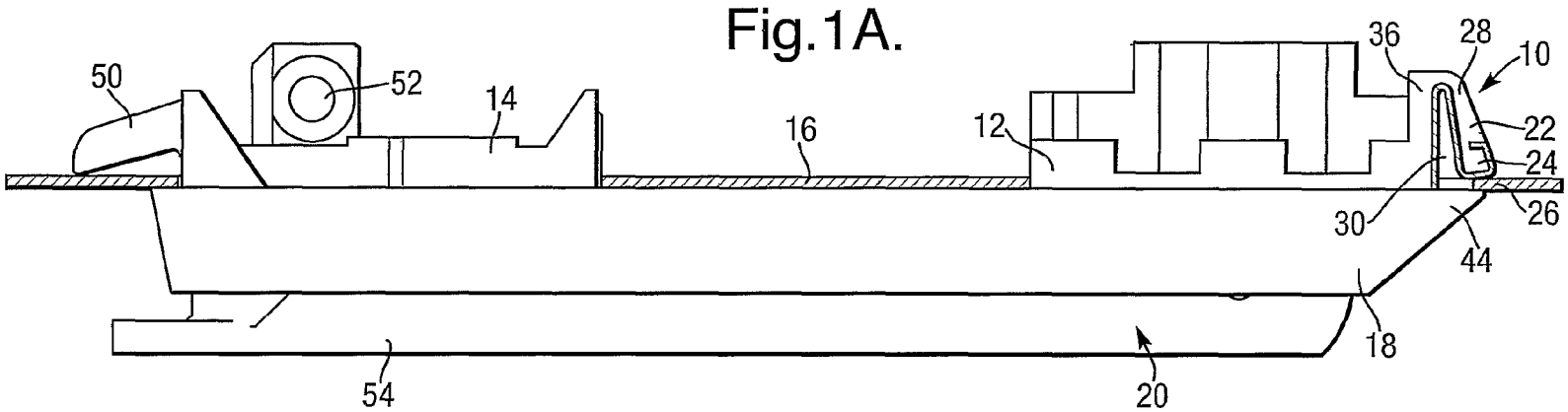
FIG. 1A shows a swivel lever control arranged at the door leaf with a fastening device according to the invention shown at the right-hand end.
Figure 1C:
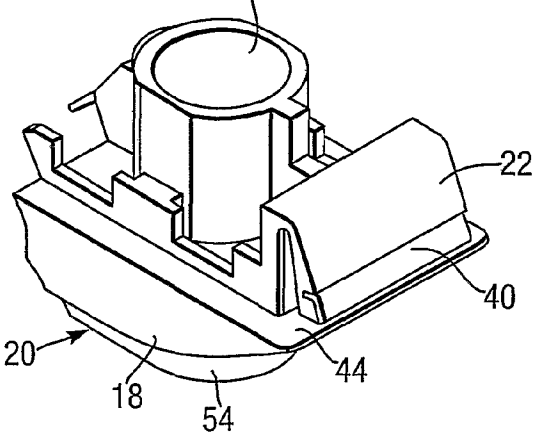
FIG. 1C shows a perspective view of the truncated end of the swivel lever closure according to FIG. 1A without the swivel lever and without a shaft.

FIG. 1A shows a side view of a fitting or housing 20 of plastic such as a swivel lever control 20, socket wrench control, or sash closure 120 with a fastening device 10 for fastening the fitting or housing 20, 120 in at least one, in this case, two, preferably rectangular openings 12, 14 in a thin wall 16 such as a sheet metal cabinet door and with tongues 22, 122 which project from the fitting or housing 20, 120 such that they are integral with the latter, the free end 24, 124 of the tongues 22, 122 being supported on the rear rim area or the edge 26 of the opening 12, 112, 14.

Figure 3A:
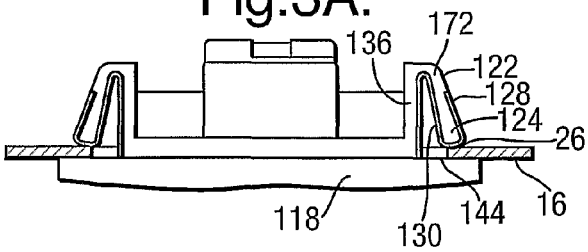
FIG. 3A shows a housing of a sash closure mounted in a door leaf.
Figure 3B:
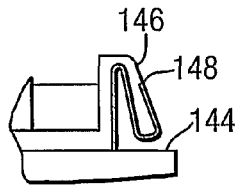
FIG. 3B shows the right-hand end of the housing shown in FIG. 3A, but not mounted in a door leaf.
Figure 3C:
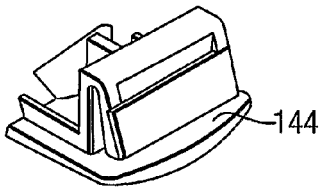
FIG. 3C shows a perspective view of the right-hand side of the housing according to FIG. 3A.
Figure 3D:
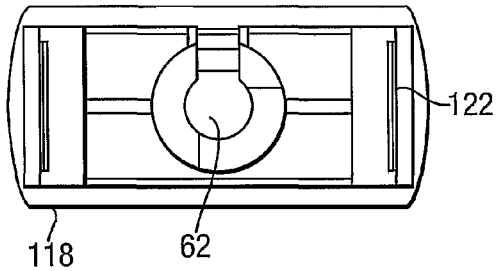
FIG. 3D shows a back view of the housing according to FIG. 3A.

According to the invention, a supporting spring 28, 128 which is made of spring metal and is bent to form a profile that is U-shaped in cross section encloses the free end 24 (see FIG. 1A) or 128 (see FIG. 3A) of the tongue 22, 122 in order to reinforce the tongue 22 and to protect it against wear during the mounting process during which the sharp edge 26 slides along the outer surface of the tongue 22. The springing force of the plastic tongue against swiveling in direction of the housing 20, 120 can be appreciably increased when a supporting leg 34, 134 proceeds from one, inner leg 30, 130 of the U-shaped profile 32, 132, this supporting leg 34, 134 resting against the housing wall 36, 136 from which the tongue 22, 122 proceeds.

In the embodiment form according to FIGS. 1A, 1B, 1C and 2, a bend 42 of the free end of the leg 38 proceeds from the other, outer leg 38, 138, this bend 42 facing toward the tongue 22 and being received in a slot 40 formed by this tongue. The spring 28 is connected to the tongue 22 particularly closely and in a positive engagement by means of this feature. This prevents the spring from slipping off from the tongue during the mounting process. A similar action is achieved in another embodiment form when the supporting leg 34, 134 of the supporting spring 28, 128 extends up to a transverse wall 44, 144 formed by the fitting 20, 120, advisably the contact surface of the trough base 18 118 of the fitting or housing 20, 120 at the thin wall or door leaf 16.

According to the embodiment forms illustrated above, the supporting leg 34, 134 forms a second U-shaped profile 66, 166 at its connection point 64, 164 to the leg of the first U-shaped profile 32, 132, the outer surfaces 68, 168 and 70, 170, respectively, of this second L-shaped profile 66, 166 facing along the housing wall 36, 136, the tongue surface 72, 172 directed to it, and the transitional area between these two surfaces in a supporting manner. This improves the supporting action.

For the same reason, it is advantageous when the width 74, 174 of the supporting spring 28, 128 is adapted to that of the tongue 22, 122 and is selected in such a way that this width can be received in the transverse extension of the rectangular opening 12, 112 without substantial play, and the spring is locked axially in the opening.

In contrast to the plastic tongue, the springing force of the supporting spring can be adapted to requirements, for example, in that, according to another embodiment form, not shown, the supporting spring has a greater material thickness at the connection point 64, 164 between the first U-shaped profile 32, 132 and the supporting leg 34, 134 and accordingly has a greater springing force than the adjoining area. Naturally, the spring in its entirety can also be made from spring metal of different thickness or different composition for adapting to the desired requirements.

The outwardly directed surface 46, 146 of the tongue 22, 122 has a recess 48, 148 for receiving the spring thickness in such a way that the abutting outer surfaces of the tongue 22, 122 on the one hand and spring 28, 128 on the other hand form a continuous, uninterrupted surface so that the edge of the opening of the thin wall can slide along the surface without interference.

Figure 1B:
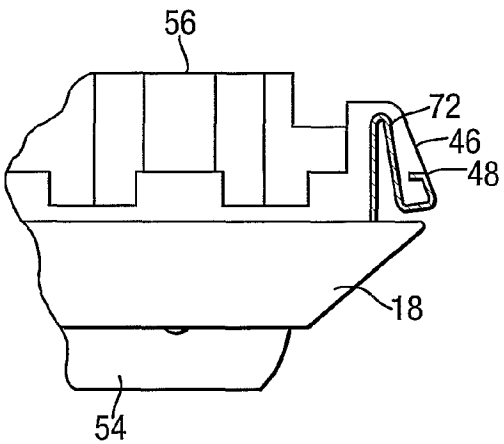
FIG. 1B shows the truncated end of a swivel lever closure according to FIG. 1A mounted in the door leaf.
Figure 2:
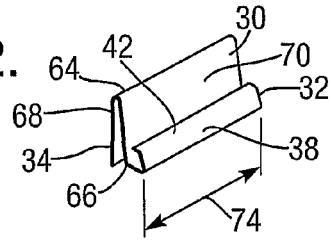
FIG. 2 shows the spring device used in the embodiment form according to FIG. 1A.

The fitting shown in FIGS. 1A, 1B (in section) and 1C (in a perspective view) is a swivel lever closure whose base 18 is provided at one end with a hook 50 which engages behind the thin wall or the door leaf 16. A fastening device 10 constructed according to the invention is located at the opposite end. Naturally, a fastening device according to the invention can be provided instead of the hook 50. Other component parts of the swivel lever closure device 20 are not shown, e.g., a profile cylinder which is mounted at 52 and the swivel lever 54 which is held in its swiveled in position inside the trough of the base 18 when closed. The swivel lever 54 is articulated at a shaft (not shown, which extends through the bearing housing with the bearing bore hole 56.

Figure 3E:
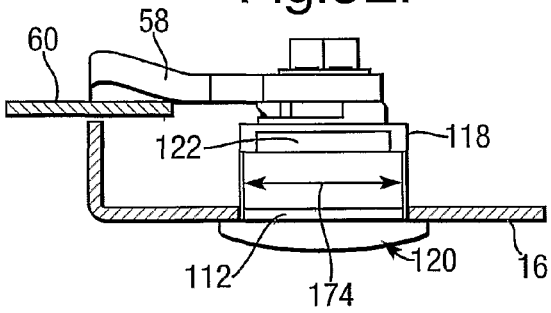
FIG. 3E shows the sash closure fully assembled and mounted in a door leaf according to the embodiment form in FIG. 3A.
Figure 4:
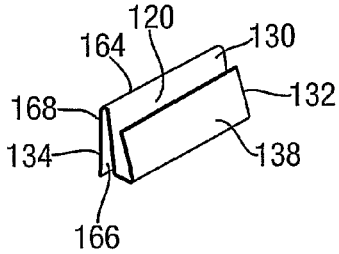
FIG. 4 is a perspective view of the spring for the embodiment form according to FIG. 3A.

FIG. 3E is a side view showing the rectangular base 118 of the sash closure 120. The sash or bolt 58 engages behind a door frame 60 and accordingly holds the door leaf 16 closed. The sash and accompanying shaft are not shown in the depiction of the housing in FIG. 3A in a side view, a three-dimensional view and a rear view, so that the bearing 62 can be seen. However, the fitting can also be the rectangular housing of a folding lever closure, wherein the fitting has a rectangular escutcheon, not shown.

The sash closure shown in FIG. 3F can also be considered as a socket wrench closure. Alternatively, a toggle control or a toggle handle or a latch handle can be used to operate the sash closure according to FIG. 3F.

Alternatively, the fitting can also be a rod guide, not shown, which can be mounted in a rectangular opening.

According to yet another alternative, the fitting is a hinge block, not shown, which can be mounted in a rectangular opening.

According to yet another alternative, the fitting can also be a lever closure, not shown, which can be mounted in a rectangular opening.

Finally, it is possible that the fitting is a handle trough which can be mounted in a rectangular opening. A corresponding construction is shown in FIG. 1A.

COMMERCIAL APPLICABILITY

The invention is commercially applicable in switch cabinet construction. While the foregoing description and drawings represent the present invention, it will invention, it will be obvious to those skilled in the art that various changes may be made therein without departing from the true spirit and scope of the present invention.

REFERENCE NUMBERS

10 fastening device
12, 112 opening
14 opening
16 thin wall, sheet metal cabinet door

18, 118 base
20, 120 fitting or housing
22, 122 tongue
24 free end
26 rear rim area, edge
28, 128 supporting spring
30, 130 inner leg
32, 132 first U-shaped profile
34, 134 supporting leg
36, 136 housing wall
38, 138 outer leg
40 slot
42 bend
44, 144 transverse wall, contact surface of the trough at the thin wall
46, 146 outwardly directed surface
48, 148 recess
50 hook
52 mounting point
54 swivel lever
56 bearing bore hole
58 sash, bolt
60 door frame
62 bearing bore hole
64, 164 connection point
66, 166 second U-shaped profile
68, 168 outer surface
70, 170 tongue surface
174 width of the supporting spring

What is claimed is:

1. A fitting of plastic comprising:

a fastening device for fixing the fitting or housing in at least one rectangular opening in a thin wall, the fastening device having tongues which project from the fitting or housing so as to be integral therewith;

wherein a free end of each tongue is configured to be supported on the rear rim area or an edge of the opening when the fitting or housing is fixed in the opening of the thin wall; and wherein a supporting spring, which is made of spring metal and which is bent to form a profile that is U-shaped in cross section, encloses the free end of each tongue.

2. The fitting according to claim 1;

wherein a supporting leg proceeds from one, inner leg of the U-shaped profile and rests against the housing wall from which the tongue projects.

3. The fitting according to claim 2;

wherein the supporting leg extends up to a transverse wall face formed by the fitting.

4. The fitting according to claim 2;

wherein a bend is provided at the end of the other, outer leg, which bend faces toward the tongue and is received in a slot formed in the latter.

5. The fitting according to claim 2;

wherein the supporting leg forms a second U-shaped profile at its connection point to the leg of the first U-shaped profile, and the outer surfaces of this second U-shaped profile faces along the housing wall, the tongue surface directed to it, and a transitional area between these two surfaces in a supporting manner.

6. The fitting according to claim 5;

wherein the width of the supporting spring is adapted to that of the tongue and is selected in such a way that this width can be received in a transverse extension of the rectangular opening without substantial play, wherein the spring is locked axially in the opening.

7. The fitting according to claim 2;

wherein the supporting spring has a greater material thickness at the connection point between the first U-shaped profile and the supporting leg and accordingly has a greater springing force than an adjoining area.

8. The fitting according to claim 1;

wherein the outwardly directed surface of the tongue has a recess for receiving the spring thickness in such a way that the abutting outer surfaces of the tongue and spring form a continuous, uninterrupted surface.

9. The fitting according to claim 1;

wherein the fitting is a trough which can be mounted for a swivel lever closure control in one or two rectangular wall openings.

10. The fitting according to claim 1;

wherein the fitting is a rectangular housing of a sash closure.

11. The fitting according to claim 1;

wherein the fitting is a rectangular escutcheon of a folding lever closure.

12. The fitting according to claim 1;

wherein the fitting is a rectangular escutcheon of a socket closure.

13. The fitting according to claim 1;

wherein the fitting is a rectangular bearing part of a toggle control, a toggle handle or a latch handle.

14. The fitting according to claim 1;

wherein the fitting is a rod guide which can be mounted in a rectangular opening.

15. The fitting according to claim 1;

wherein the fitting is a hinge block which can be mounted in a rectangular opening.

16. The fitting according to claim 1;

wherein the fitting is a lever closure which can be mounted in a rectangular opening.

17. The fitting according to claim 1;

wherein the fitting is a handle trough which can be mounted in a rectangular opening.

18. The fitting according to claim 1;

wherein the fitting is a hand grip which can be mounted in a rectangular opening.

* * * * *